US009339773B2

(12) United States Patent
Harris et al.

(10) Patent No.: US 9,339,773 B2
(45) Date of Patent: May 17, 2016

(54) CHEMICAL DISPENSING APPARATUS AND RELATED METHODS

(71) Applicant: Hydra-Flex, Inc., Burnsville, MN (US)

(72) Inventors: Jaime L. Harris, Rosemount, MN (US); Karl J. Fritze, Hastings, MN (US); Zachary Cornett, Lakeville, MN (US)

(73) Assignee: Hydra-Flex, Inc., Burnsville, MN (US)

( * ) Notice: Subject to any disclaimer, the term of this patent is extended or adjusted under 35 U.S.C. 154(b) by 268 days.

(21) Appl. No.: 13/755,964

(22) Filed: Jan. 31, 2013

(65) Prior Publication Data

US 2013/0200102 A1 Aug. 8, 2013

Related U.S. Application Data

(60) Provisional application No. 61/593,118, filed on Jan. 31, 2012.

(51) Int. Cl.

| | |
|---|---|
| ***B01F 3/08*** | (2006.01) |
| ***B01F 5/04*** | (2006.01) |
| ***B01F 13/10*** | (2006.01) |

(52) U.S. Cl.

CPC ..... *B01F 3/08* (2013.01); *B01F 3/0865* (2013.01); *B01F 5/0428* (2013.01); *B01F 13/1055* (2013.01); *B01F 2003/0896* (2013.01); *B01F 2215/004* (2013.01)

(58) Field of Classification Search

CPC .. B01F 5/0403; B01F 13/1055; B01F 3/0865; B01F 5/0428; B01F 2003/0896; B01F 2215/004

USPC ..... 222/135, 145.5, 145.1, 145.6, 160, 416, 222/181.2; 141/100, 9, 165

See application file for complete search history.

(56) References Cited

U.S. PATENT DOCUMENTS

| | | | | |
|---|---|---|---|---|
| 5,293,913 | A * | 3/1994 | Preszler | 141/367 |
| 5,832,972 | A | 11/1998 | Thomas et al. | |
| 5,896,898 | A * | 4/1999 | Crossdale et al. | 141/83 |
| 6,363,977 | B1 * | 4/2002 | Smeller et al. | 141/18 |
| 6,439,272 | B1 * | 8/2002 | Wertheim | 141/2 |
| 8,322,367 | B2 | 12/2012 | Harris et al. | |
| 8,640,742 | B2 * | 2/2014 | Crossdale et al. | 141/2 |
| 2007/0102540 | A1 * | 5/2007 | MacLean-Blevins | 239/310 |
| 2010/0276922 | A1 | 11/2010 | Rehder et al. | |
| 2011/0067738 | A1 | 3/2011 | Molitor et al. | |
| 2011/0192433 | A1 | 8/2011 | Harris et al. | |
| 2012/0199615 | A1 | 8/2012 | O'Keefe et al. | |
| 2012/0325853 | A1 | 12/2012 | Harris et al. | |

* cited by examiner

*Primary Examiner* — Frederick C Nicolas
*Assistant Examiner* — Robert Nichols, II
(74) *Attorney, Agent, or Firm* — Dorsey & Whitney LLP

(57) ABSTRACT

A chemical dispensing assembly having injector assemblies that combine a solvent stream with a concentrate stream within a Venturi injector assembly to produce a chemical solution outlet stream. Each injector assembly has an interchangeable metering assembly that limits the flow of concentrate into the Venturi injector assembly to change the resulting concentration of the concentrate within the solution outlet stream. The chemical dispensing assembly also has a keyed connector system that prevents the connection of the wrong concentrate container to the wrong injector assembly.

13 Claims, 16 Drawing Sheets

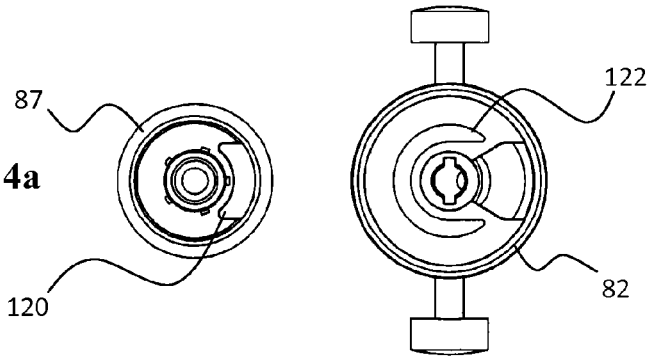
Figure 14a
Figure 14b
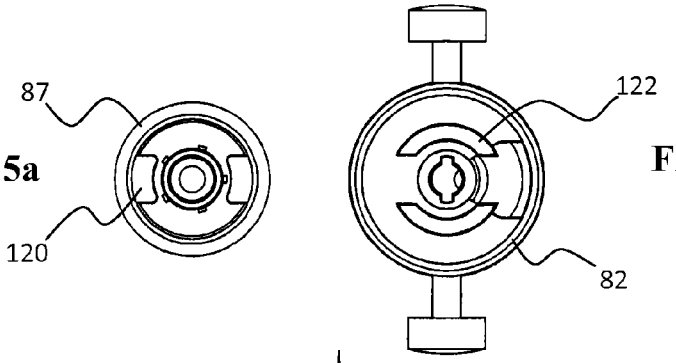
Figure 15a
Figure 15b
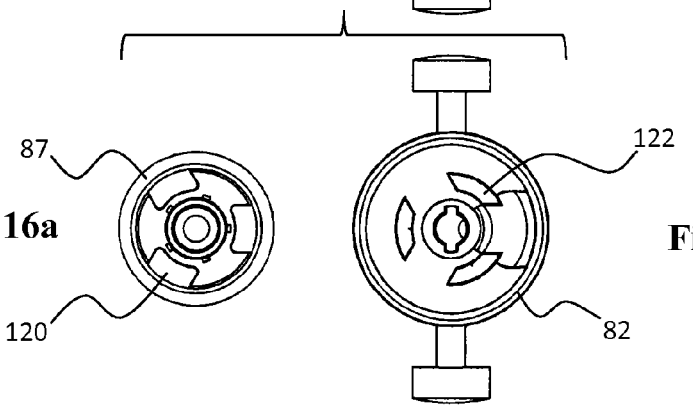
Figure 16a
Figure 16b

CHEMICAL DISPENSING APPARATUS AND RELATED METHODS

RELATED APPLICATION

The present application claims the benefit of U.S. Provisional Application No. 61/593,118 entitled CHEMICAL DISPENSING APPARATUS AND RELATED METHODS and filed Jan. 31, 2012, which is incorporated herein in its entirety.

FIELD OF THE INVENTION

The present invention is generally directed to a chemical dispensing apparatus and related methods of mixing chemical solutions from concentrates and dispensing the mixed chemical solutions. Specifically, the present invention is directed to a chemical dispensing apparatus capable of sequentially mixing a plurality of chemical solutions from different concentrates and dispensing the mixed solutions through a single conduit or shared conduits.

BACKGROUND OF THE INVENTION

Many chemical systems create a plurality of chemical solutions by mixing various concentrates with a solvent stream, typically water, before dispensing the mixed chemical solutions from the chemical system. The chemical solutions are often mixed sequentially such that each chemical solution can be individually fed into a shared outlet for use. Specifically, the systems often provide a continuous solvent stream to which the concentrates are sequentially added to create a plurality of segments in the solvent stream that comprise the desired chemical solutions. Alternatively, a slug of solvent is combined with a slug of concentrate to form a quantity of solution that is fed into the outlet. The sequential mixing of the chemical solutions allow a single system to provide a plurality of different chemical solutions from concentrates that are incompatible or would be less effective if combined into a single chemical solution. Similarly, the sequential mixing can allow certain chemical solutions to be applied in specific sequences providing additional advantages. A common application for the sequential systems is automated car washes and other cleaning systems in which cleaning, rising, and protective chemical solutions are applied sequentially to a vehicle or object to be cleaned.

A primary consideration for the mixing systems is efficiently mixing each of the chemical solutions such that chemical solution can be quickly mixed and dispensed through the common outlet before the next chemical solution is prepared. Typically, a diaphragm or similar valve draws a slug of fluid from the concentrate container and combines the concentrate slug with a solvent stream or a solvent slug to create a chemical solution stream. When a solvent stream is provided, the diaphragm valve is often operated to draw a series of slugs to provide a continuous solution stream. In this configuration, an inherent challenge is mixing the slug flow of the concentrate stream with the continuous solvent stream such that the concentrate is evenly distributed throughout the solvent stream at the appropriate concentration. Similarly, selecting the appropriate slug size and frequency to create the appropriately concentrated solution stream can be particularly challenging and be varied depending on the type of concentrate. With slug solvent flow, creating the appropriate sized solvent slug for the corresponding concentrate slug can be particularly challenging. An additional challenge is that the non-continuous slug flow can place greater strain on the valves and other systems than a continuous flow system.

A common consideration for the mixing systems is resupplying the mixing system when one or more of the concentrates is exhausted. The mixing systems often comprise a plurality of interface assemblies each connectable to an individual concentrate supply container to draw concentrate from the supply container. The mixing systems are often automated to draw the predetermined amounts of concentrate from the connected concentrate supply container at pre-programmed times or if the controller determines that the specific chemical solution is required. However, if the incorrect concentrate container is connected to the interface the wrong concentrate will be combined with the solvent stream resulting in the incorrect chemical solution being created. The systems often use many different concentrates with equally many different interfaces making connecting the correct concentrate container difficult. In addition, many concentrates can have similar names and appearances further increasing the challenge for operators to correctly replace the concentrate containers.

Although mixing systems capable of providing a plurality of different chemical solutions individually provide numerous advantages, a number of challenges still remain regarding the efficient and accurate mixing of the chemical solutions as well as an accurate means of resupplying the system with additional concentrate.

SUMMARY OF THE INVENTION

The present invention is generally directed to a chemical dispensing assembly comprising a dispensing manifold further comprising at least one injector assembly for combining a solvent stream with a concentrate stream drawn from a concentrate container to form a chemical solution stream. Each injector assembly comprises a secondary line extending between a motive fluid inlet and a common outlet assembly and further comprising a Venturi injector assembly through which the solvent stream is directed to create a vacuum at the necked portion of the Venturi injector assembly. A concentrate tube connected to the concentrate container at one end and fluidly connected to the necked portion of the Venturi injector assembly at the other end allows the vacuum created by the flow of the solvent stream through the necked portion to draw concentrate from the concentrate container into Venturi injector assembly and combine the concentrate stream with the solvent stream. The amount of concentrate drawn is directly proportional to the flow rate of solvent through the Venturi injector assembly providing an accurate and consistent means of mixing the chemical solution at the correct concentration.

In certain aspects of the present invention, the concentrate tube can further comprise a metering assembly positioned at the end of the concentrate tube engaged to the Venturi injector assembly. The metering assembly can further comprise a restrictor plug that reduces the cross-sectional area of the concentrate tube limiting the flow of concentrate drawn through the concentrate tube by the vacuum created by the flow of the solvent stream through the venture injector assembly. In one aspect, the restrictor plug can further comprise a channel sized to defining an opening through which concentrate can be drawn by the vacuum. The number of turns, the diameter of the channel, the angle of the channel and other channel characteristics and dimensions can be varied to change the flow of concentrate around the restrictor plug. In certain aspects, the restrictor plug can be interchanged with restrictor plugs in which the channels have different characteristics to provide a different concentrate flow rate thereby regulating the concentration of the resulting chemical solution. In one aspect, the metering assembly can further comprise a one-way valve allowing fluid to be fed into the Venturi injector assembly from the concentrate container, but preventing backflow of fluid from the Venturi injector assembly.

In certain aspects of the present invention, the chemical dispensing assembly can further comprise a locking assembly for securing the concentrate container to the concentrate tube. The locking assembly further comprises an engagement head to which the end of concentrate tube opposite the metering assembly is attached. The engagement head is movable between an engaged position in which the end of the concentrate tube is fluidly connected to the opening of the concentrate container and a disengaged position in which the concentrate tube is disconnected from the concentrate container. In one aspect, the locking assembly can further comprise a one-way valve allowing fluid to be drawn from the concentrate container, but preventing backflow of fluid into the concentrate container. In one aspect, the chemical dispensing assembly can further comprise a container support shelf for supporting the concentrate container. In this configuration, the container support shelf can comprise an alignment element engagable to the concentrate container to position the concentrate container such that the container opening is aligned with the engagement head for fluidly connecting the concentrate tube with the concentrate container when the engagement head is moved into the engaged position.

In one aspect, the concentrate container further comprises a container insert having a keyed connector operably linked to a concentrate tube. The keyed connector is positioned at the opening of the concentrate container. In this configuration, the engagement head further comprises a corresponding connector interfacing with the keyed connector to link the concentrate tube to the concentrate tube when the engagement head is positioned in the engaged position. Each keyed connector comprises at least one tab interfacing with at least one tab of the corresponding connector, wherein the arraignment, positioning and/or size of the tabs are varied to prevent connection of keyed connector with non-corresponding connectors. The keyed connectors prevent attachment of the wrong concentrate containers to the injector assembly. In one aspect, the concentrate tube can further comprise a screen or filter to prevent solids, participated crystals or other particulates from entering the concentrate tube and being drawn into the injector assembly.

In another aspect, a chemical dispensing assembly, according to an embodiment of the present invention, can comprise a motive fluid inlet, an outlet assembly, at least one concentrate container and at least one injector assembly comprising a secondary line linking the motive fluid inlet to the outlet assembly. The injector assembly further comprises a concentrate tube and a Venturi injector assembly having a necked portion. In operation, the concentrate tube fluidly connects the necked portion of the Venturi injector assembly with the concentrate container, wherein feeding a solvent stream from the motive fluid inlet through the Venturi injector assembly creates a vacuum in the necked portion drawing concentrate from the concentrate container and combining the concentrate stream with the solvent stream. In certain embodiments, the concentrate tube can further comprise a metering assembly having an interchangeable restrictor plug constricting the flow of concentrate through the concentrate tube to change the resulting concentration of the mixed chemical solution. In certain embodiments, the injector assembly can further comprise an engagement head movable to fluidly connect and disconnect the end of the concentrate tube with the concentrate container. In this configuration, the container can further comprise an insert positioned in the opening of the container and comprising a keyed connector preventing fluid connection of the concentrate tube with the container when the wrong container is used.

In yet another aspect, a method of formulating a chemical solution comprising drawing a solvent stream from a motive fluid inlet and directing the solvent stream through a Venturi injector assembly such that the solvent stream enters a necked portion of the Venturi injector assembly creating a vacuum at the necked portion. The method further comprises fluidly connecting the necked portion of the Venturi injector assembly and a concentrate container with a concentrate tube to draw a concentrate stream from the concentrate container with the vacuum created in the necked portion. The method also comprises a positioning a first restrictor plug within the concentrate tube comprising a first channel having a first cross-sectional area smaller than the cross-sectional area of the concentrate tube to reduce the effective cross-sectional area of the tube limiting the flow of the concentrate stream through the concentrate tube. The method further comprises exchanging the first restrictor plug with a second restrictor plug comprising a second channel having a second cross-sectional area different from the first cross-sectional area of the first channel.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 14*a* is a top view of a container insert according to an embodiment of the present invention.

FIG. 14*b* is a bottom view of an engagement head according to an embodiment of the present invention.

FIG. 15*a* is a top view of a container insert according to an embodiment of the present invention.

FIG. 15*b* is a bottom view of an engagement head according to an embodiment of the present invention.

FIG. 16*a* is a top view of a container insert according to an embodiment of the present invention.

FIG. 16*b* is a bottom view of an engagement head according to an embodiment of the present invention.

Figure 1:
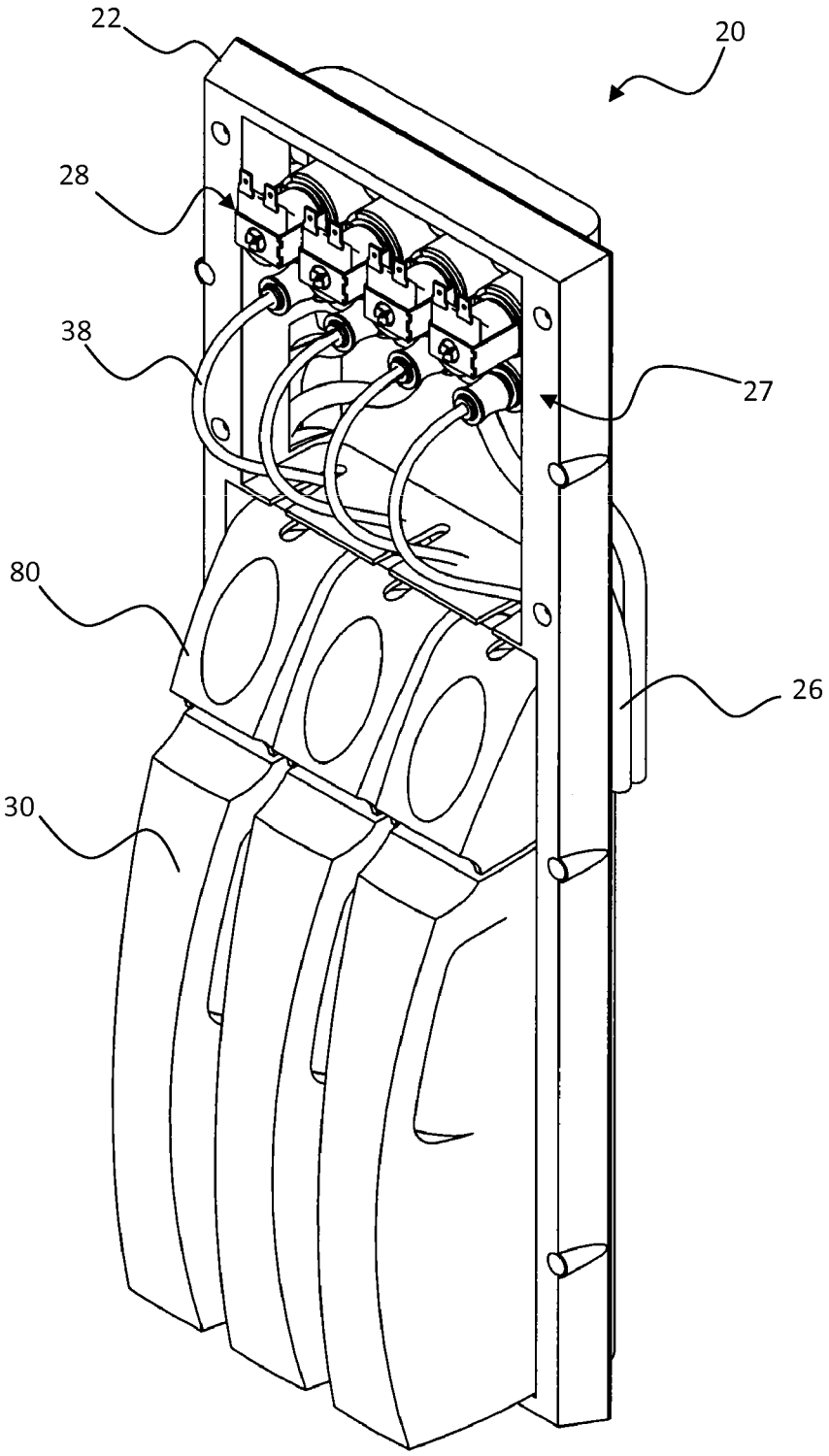
FIG. 1 is a perspective view of a chemical dispensing assembly according to an embodiment of the present invention.
Figure 2:
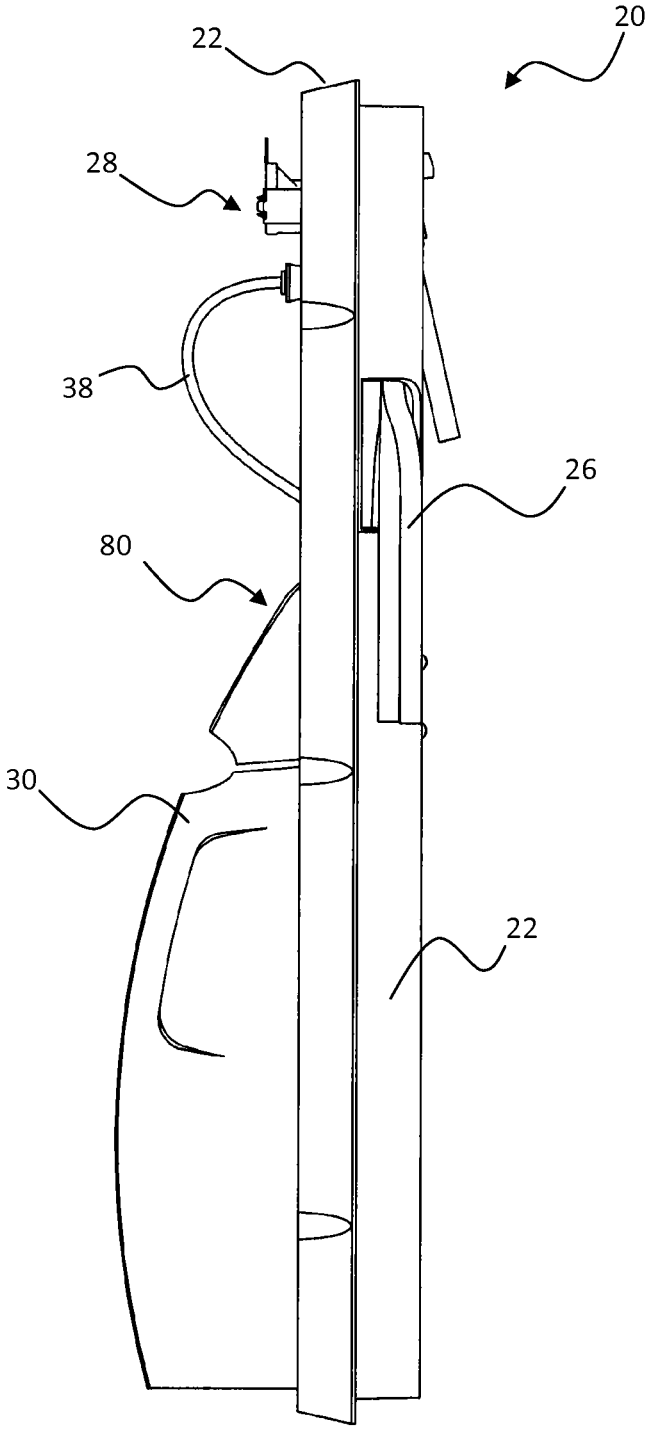
FIG. 2 is a side view of the chemical dispensing assembly depicted in FIG. 1.
Figure 3:
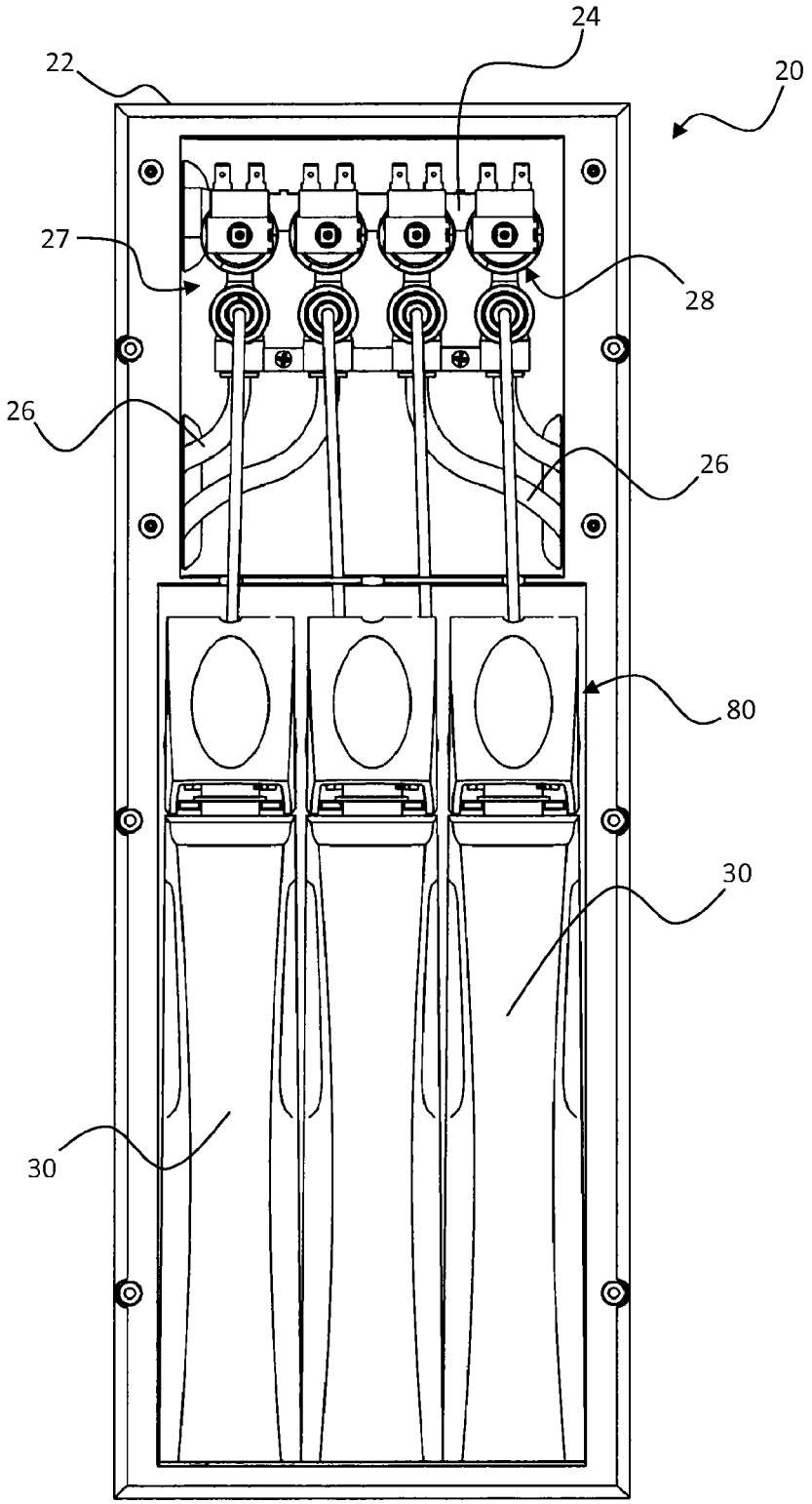
FIG. 3 is a front view of the chemical dispensing assembly depicted in FIG. 1.
Figure 4:
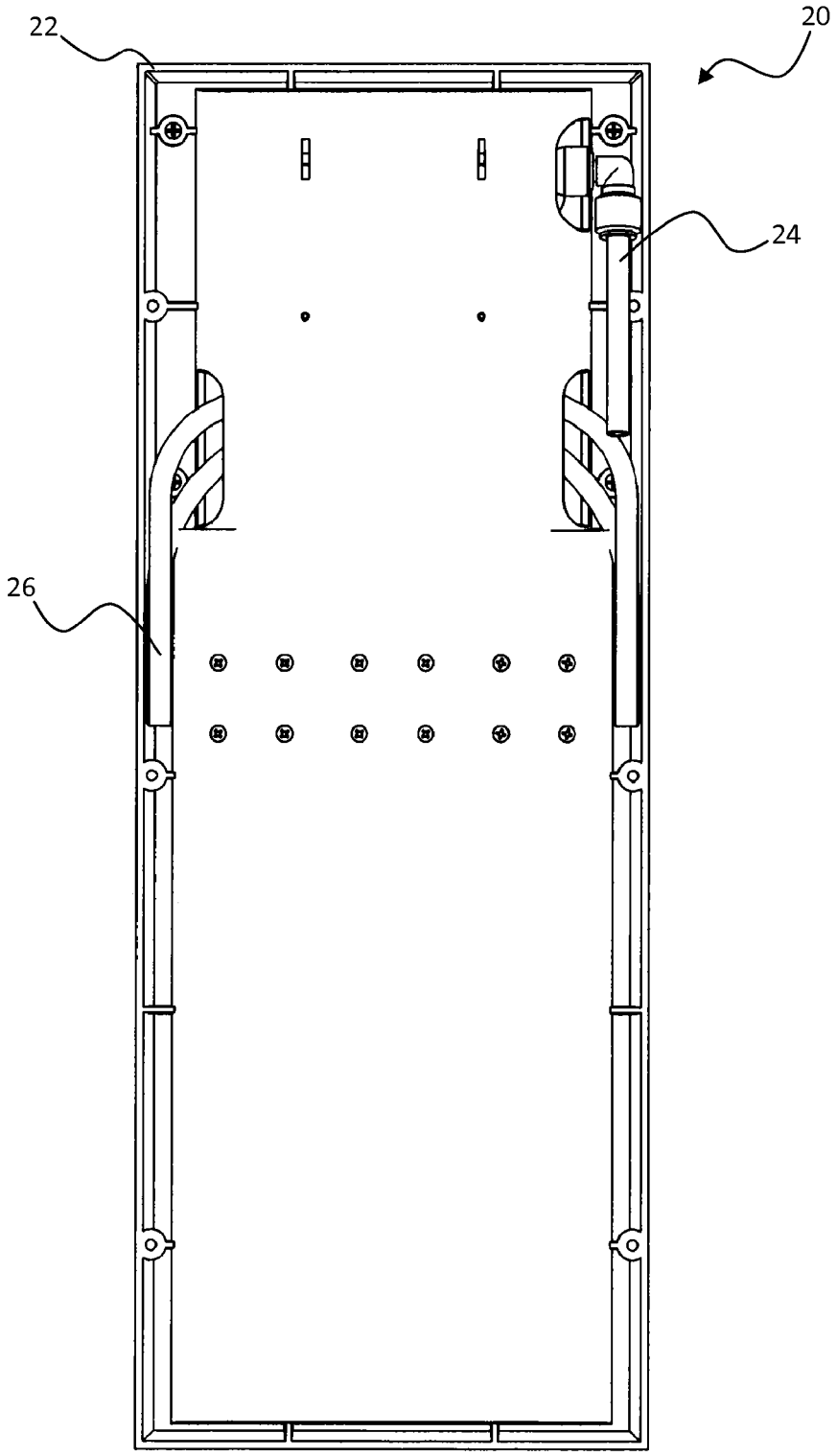
FIG. 4 is a rear view of the chemical dispensing assembly depicted in FIG. 1.
Figure 5:
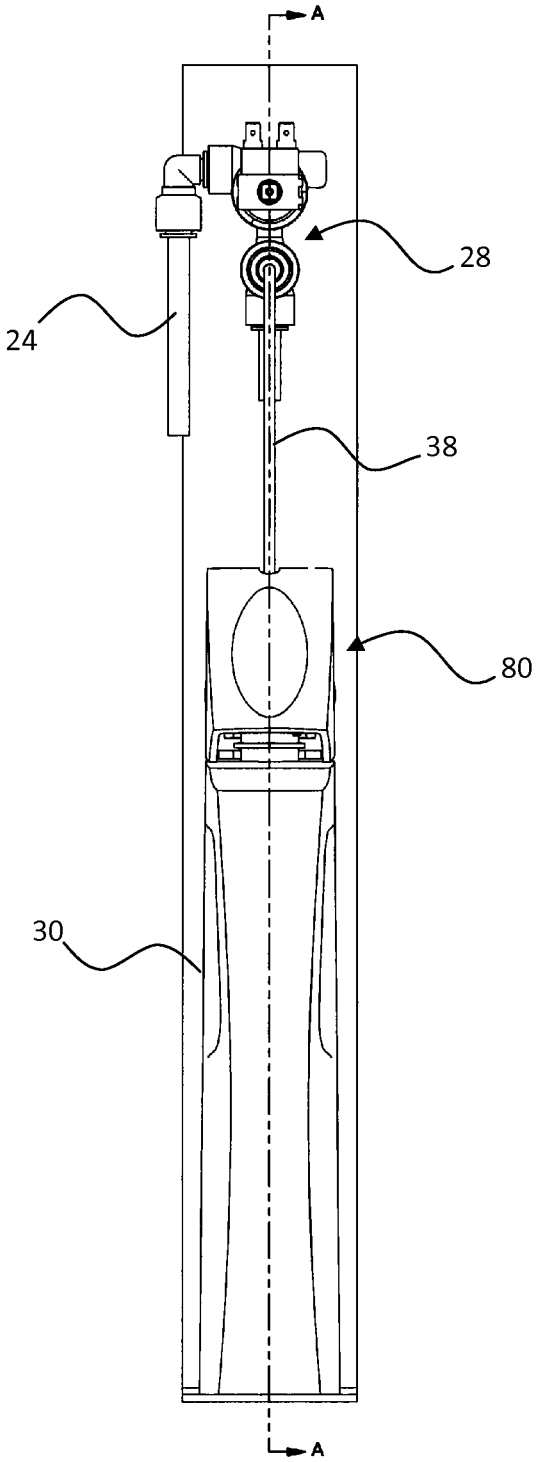
FIG. 5 is an isolated front view of an injector assembly and a concentrate container according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As depicted in FIGS. 1-4 and 11, a chemical dispensing assembly 20, according to an embodiment of the present invention, comprises a mounting frame 22, an inlet line 24, a solution outlet line 26 and a dispensing manifold 27 having at least one injector assembly 28 fluidly connectable to at least one concentrate container 30. The mounting frame 22 comprises connection points for securing and positioning the inlet line 24, the solution outlet line 26 and each injector assembly 28. The inlet line 24 is fluidly connectable to a motive fluid inlet for supplying a quantity of solvent or a solvent stream to the injector assembly 28. Similarly, the solution outlet line 26 is fluidly connectable to an outlet assembly for receiving and using the mixed chemical solution output from the injector assembly 28. The injector assembly 28 comprises a secondary line 32 fluidly connecting the inlet line 24 with the solution outlet line 26. As depicted in FIGS. 1-4, a plurality of injector assemblies 28 can be operably linked to a single inlet line 24 and each linked to an individual solution outlet line 26. In other embodiments, the plurality of injector assemblies 28 can have individual inlet lines 24 and/or a shared solution outlet line 26. In other embodiments, the chemical dispensing assembly 20 can have a single inlet line 24, a single injector assembly 28 and a single solution outlet line 26.

As depicted in FIGS. 1, 3, 5 and 11, each injector assembly 28 can further comprise an injector assembly 34, a concentrate supply line 38 and a Venturi injector assembly 40 defining a necked portion 42. The injector assembly 34 defines the secondary line 32 linking the inlet line 24 with the solution outlet line 26. The concentrate supply line 38 is fluidly connected to the secondary line 32 at one end through a port 36 in the necked portion 42 of the Venturi injector assembly 40. The opposite end of the concentrate supply line 38 is fluidly connectable to the concentrate container 30. In operation, the Venturi injector assembly 40 is positioned in the secondary line 32 such that the solvent stream from the inlet line 24 is directed through the necked portion 42 and undergoes a pressure change to create a vacuum at the necked portion 42. The vacuum created at the necked portion 42 draws concentrate from the concentrate container 30 to entrain and mix the concentrate within the solvent stream to produce a chemical solution stream or a quantity of chemical solution.

Figure 11:
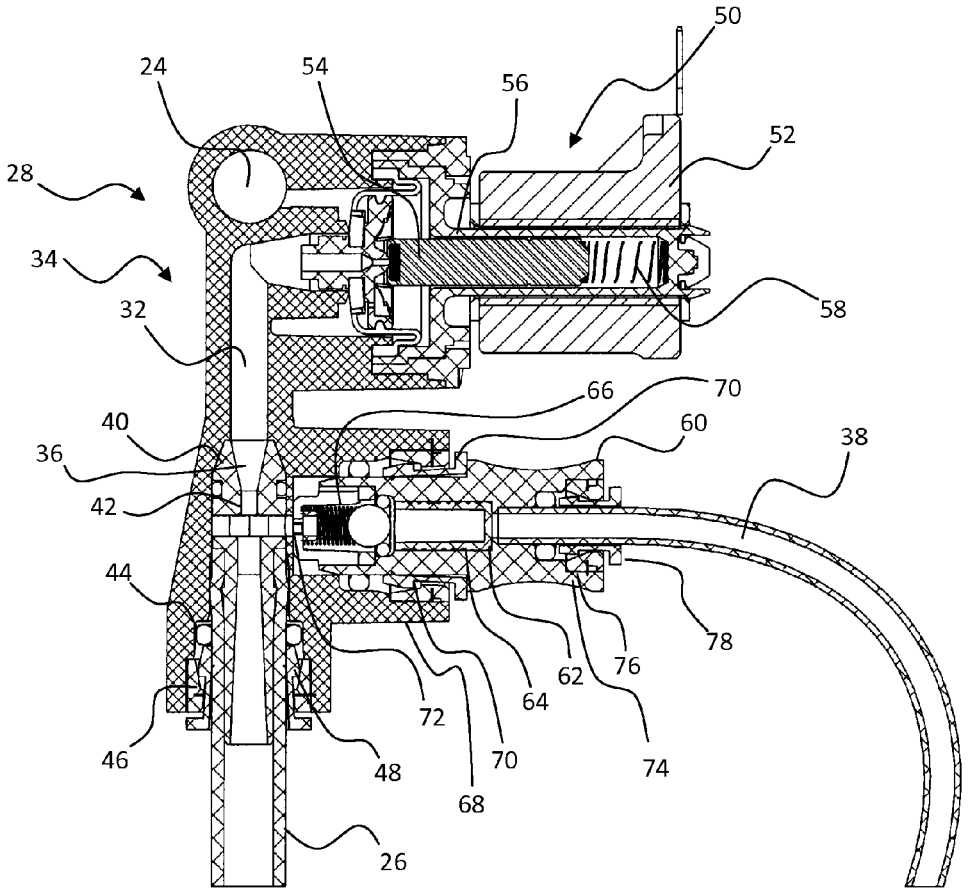
FIG. 11 is a cross-sectional side view of an injector assembly according to an embodiment of the present invention.
Figure 12:
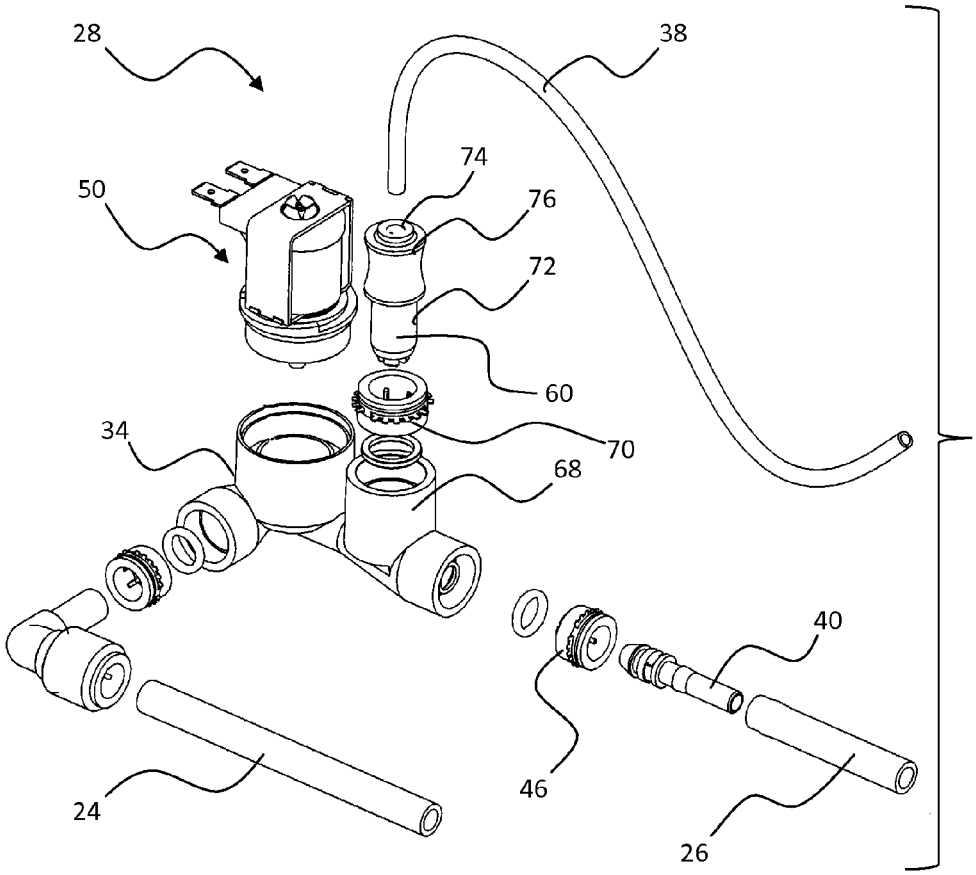
FIG. 12 is an exploded view of an injector assembly according to an embodiment of the present invention.
Figure 13:
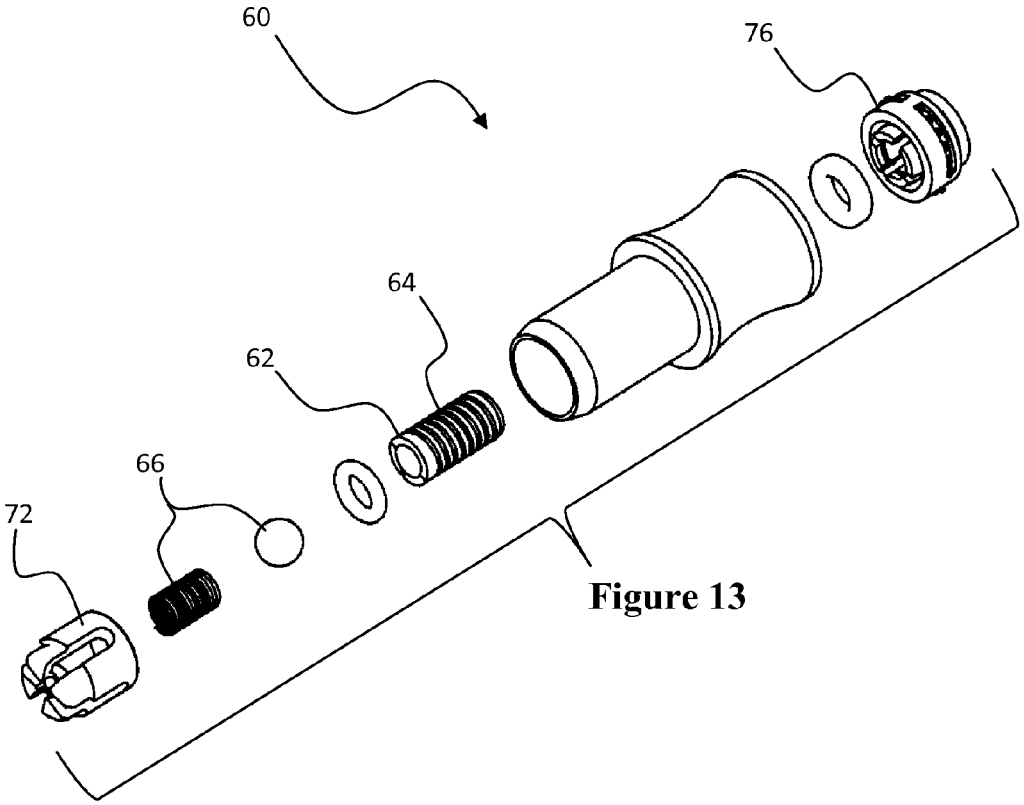
FIG. 13 is an exploded view of metering assembly of the present invention.
Figure 17:
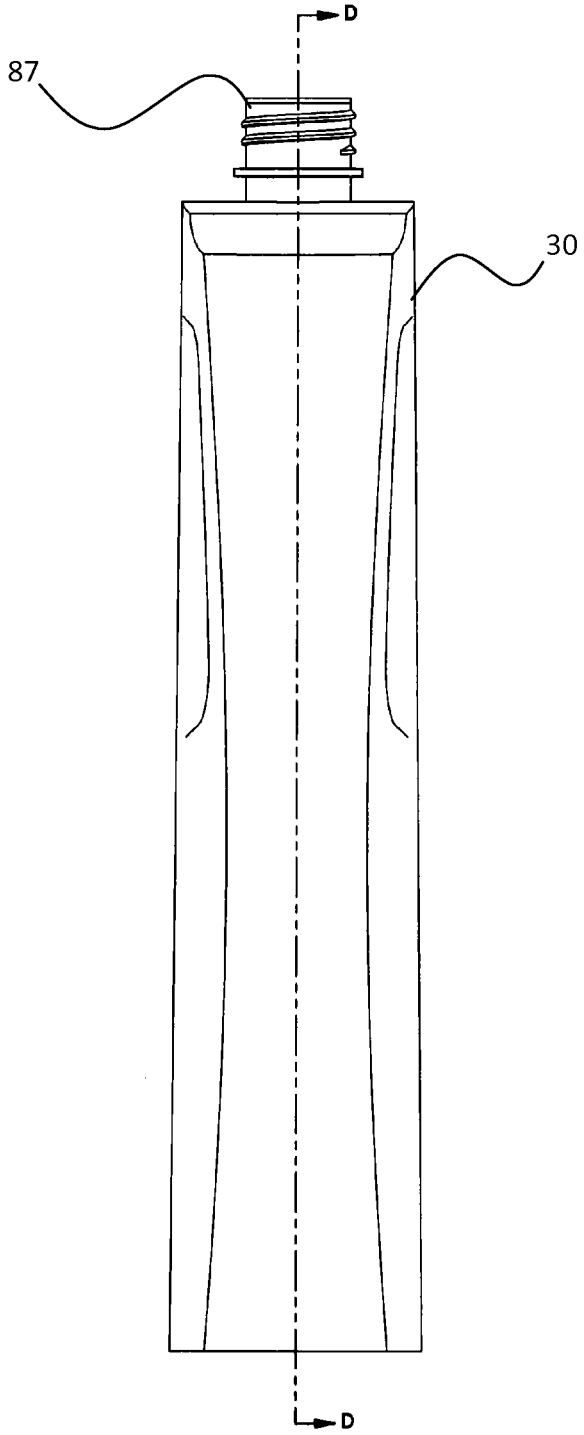
FIG. 17 is a front view of a concentrate container according to an embodiment of the present invention.
Figure 18:
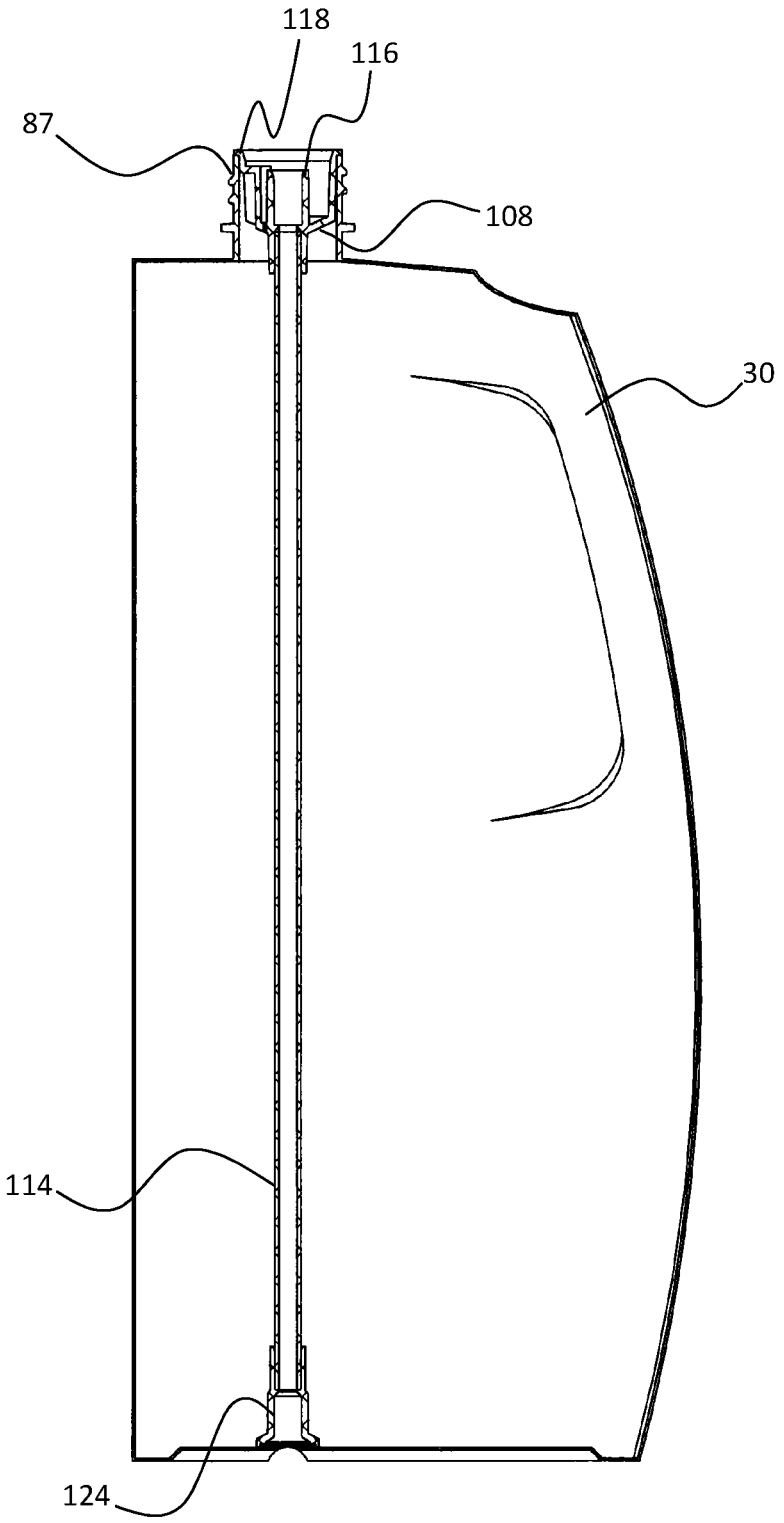
FIG. 18 is a side cross-sectional view of a concentrate container having a container insert according to an embodiment of the present invention.

As depicted in FIGS. 11 and 13, in certain embodiments, the injector assembly 34 can further comprise a port 44 comprising at least one engagement element 46, such as a protruding tab, engagable with a corresponding engagement element 48 on the solution outlet line 26. The port 44 can further comprise an o-ring, gasket or other sealing means for preventing leakage at the interface between the port 44 and the solution outlet line 26.

As depicted in FIG. 11, in certain embodiments, the injector assembly 28 can further comprise an inlet valve 50 controlling flow of the solvent from the inlet line 24. As depicted in FIG. 11, the inlet valve 50 can comprise a solenoid valve comprising a valve housing 52, a plunger 54, a solenoid coil 56 and a spring 58, wherein the spring 58 biases the plunger 54 to obstruct the secondary line 32 preventing flow of solvent through the secondary line 32 until a current is supplied to the solenoid coil 56 to induce an electromagnetic field retracting the plunger 54. In other embodiments, the inlet valve 50 can comprise a diaphragm valve and other conventional valve type capable electronic control of the flow of solvent through the secondary line 32.

As depicted in FIG. 11, each injector assembly 28 can further comprise a metering assembly 60 comprising a restrictor plug 62 aligned with the concentrate supply line 38 to reduce the effective cross-sectional area of the concentrate supply line 38. The metering restrictor plug 62 effectively plugs the concentrate supply line 38 and comprises a helical channel 64 defining a restricted flow path past the restrictor plug 62. In certain embodiments, the helical channel 64 draws concentrate through the helical channel 64 through capillary action assisted by the vacuum created by the necked portion 42 of the Venturi injector assembly 40. The number of turns, the diameter of the channel 64, the angle of the turns of the channel 64 and other channel 64 characteristics and dimensions can be varied to change the flow of concentrate through the restrictor plug 62. In certain embodiments, the restrictor plug 62 can be interchanged with restrictor plugs 62 having different channel characteristics to provide a different concentrate flow rate to alter the resulting concentration of the mixed chemical solution. In certain embodiments, the metering assembly 60 can further comprise a ball valve 66 biased to only allow one-way flow of the concentrate into the necked portion 42 while preventing back flow of the mixed chemical solution into the concentrate supply line 38.

As depicted in FIG. 11, in certain embodiments, the metering assembly 60 can comprise a modular arrangement in which the metering assembly 60 can be replaced to install different metering assembly 60 having a restrictor plug 62 having different channel characteristics thereby changing the flow rate of concentrate into the Venturi injector assembly 40. In this configuration, the injector assembly 34 can further comprise a port 68 comprising at least one engagement element 70, such as a protruding tab, engagable with a corresponding engagement element 72 on the metering assembly 60. The port 68 can further comprise an o-ring, gasket or other sealing means for preventing leakage at the interface between the port 68 and the metering assembly 60. Similarly, the metering assembly 60 can further comprise a port 74 comprising at least one engagement element 76, such as a protruding tab, engagable with a corresponding engagement element 78 on the concentrate supply line 38. The port 74 can further comprise an o-ring, gasket or other sealing means for preventing leakage at the interface between the metering assembly 60 and the concentrate supply line 38.

As depicted in FIGS. 6-10, in certain embodiments, the chemical dispensing assembly 20 can further comprise a locking assembly 80 for fluidly connecting the concentrate supply line 38 with the concentrate container 30. The locking assembly 20 further comprises a engagement head 82 for receiving an end of the concentrate supply line 38 and movable in a vertical axis between an engaged position in which the end of the concentrate supply line 38 is fluidly connected with the concentrate container 30 and a disengaged position in which the end of the concentrate supply line 38 is disconnected from the concentrate container 30. The engagement head 82 further comprises a port 84 fluidly connected to an adapter 86 insertable into a mouth 87 of the concentrate container 30 to fluidly connect the concentrate supply line 38 with the concentrate container 30 when the engagement head 82 is moved into the engaged position. The port 84 further comprises at least one engagement element 88, such as a protruding tab, engagable with a corresponding engagement element 90 on the concentrate supply line 38 to fluidly connect the concentrate supply line 38 to the adapter 86. In certain embodiments, the engagement head 82 can further comprise a ball valve 92 biased to only allow one-way flow of the concentrate into the adapter 86 from the concentrate container 30 while preventing back flow of solution or concentrate from the concentrate supply line 38.

Figure 6:
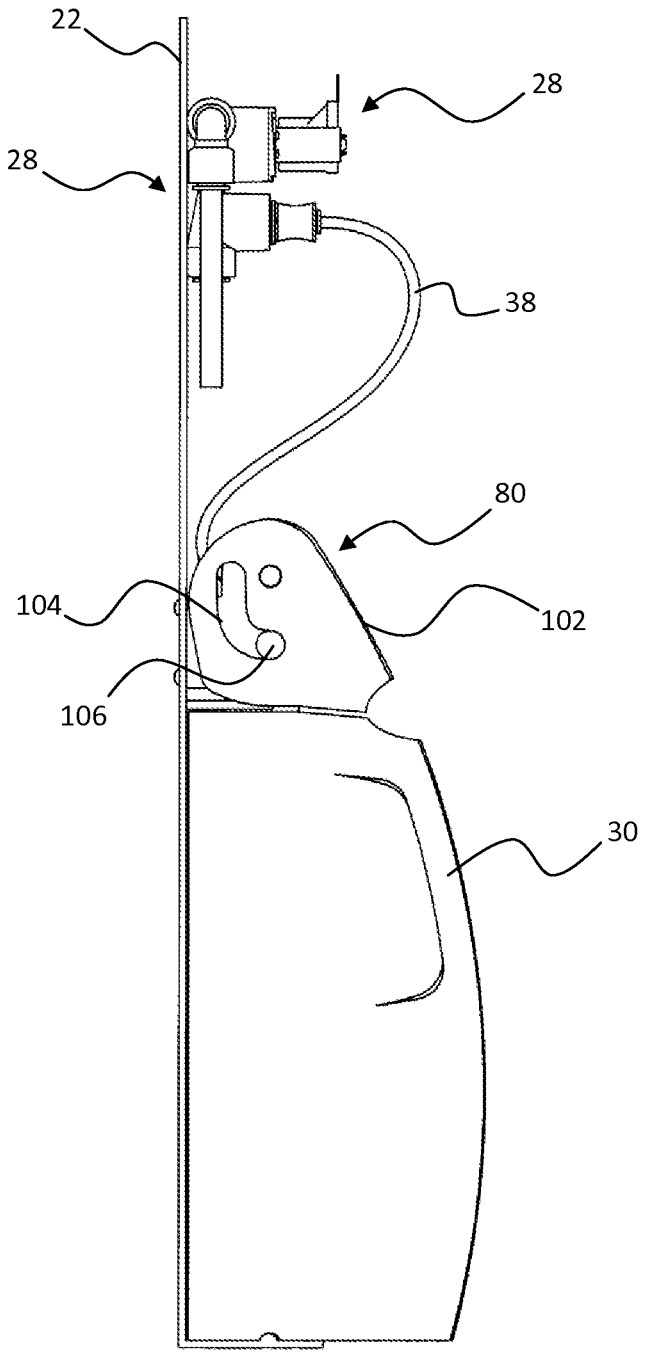
FIG. 6 is a side view of the injector assembly and concentrate container depicted in FIG. 5, wherein the concentrate container is fluidly connected to the injector assembly.
Figure 7:
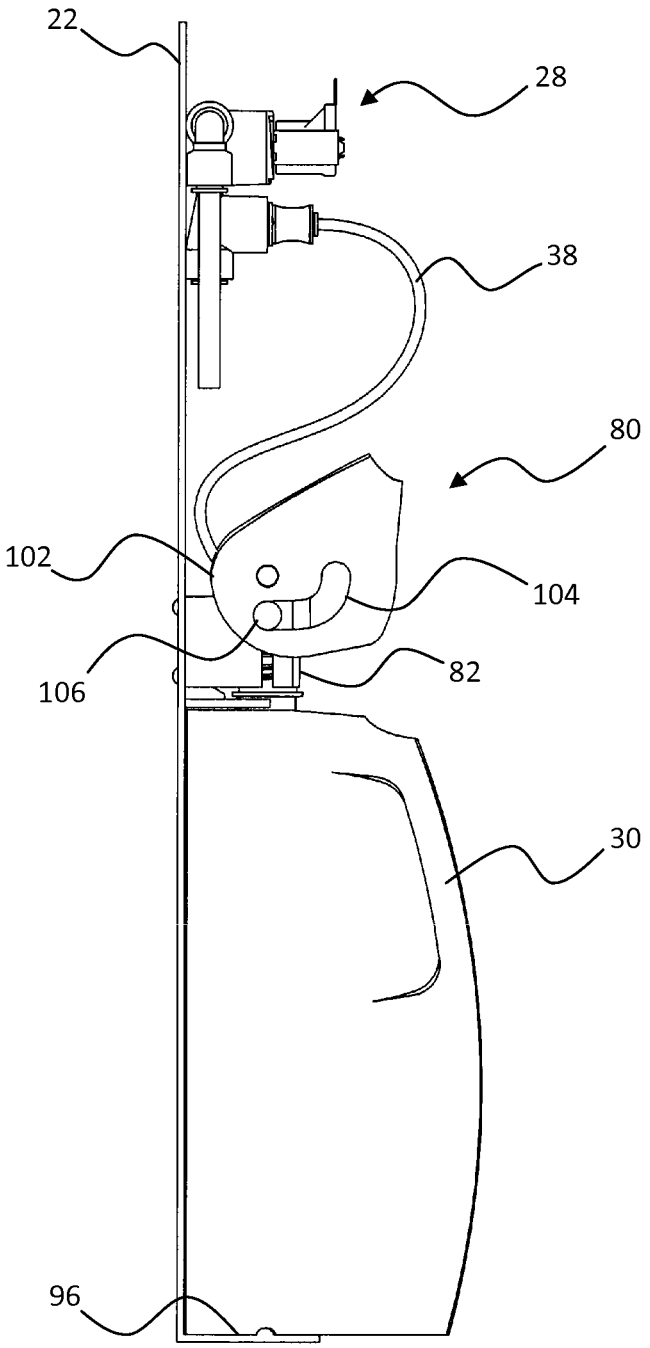
FIG. 7 is a side view of the injector assembly and concentrate container depicted in FIG. 5, wherein the concentrate container is positioned for fluid connection to the injector assembly.
Figure 8:
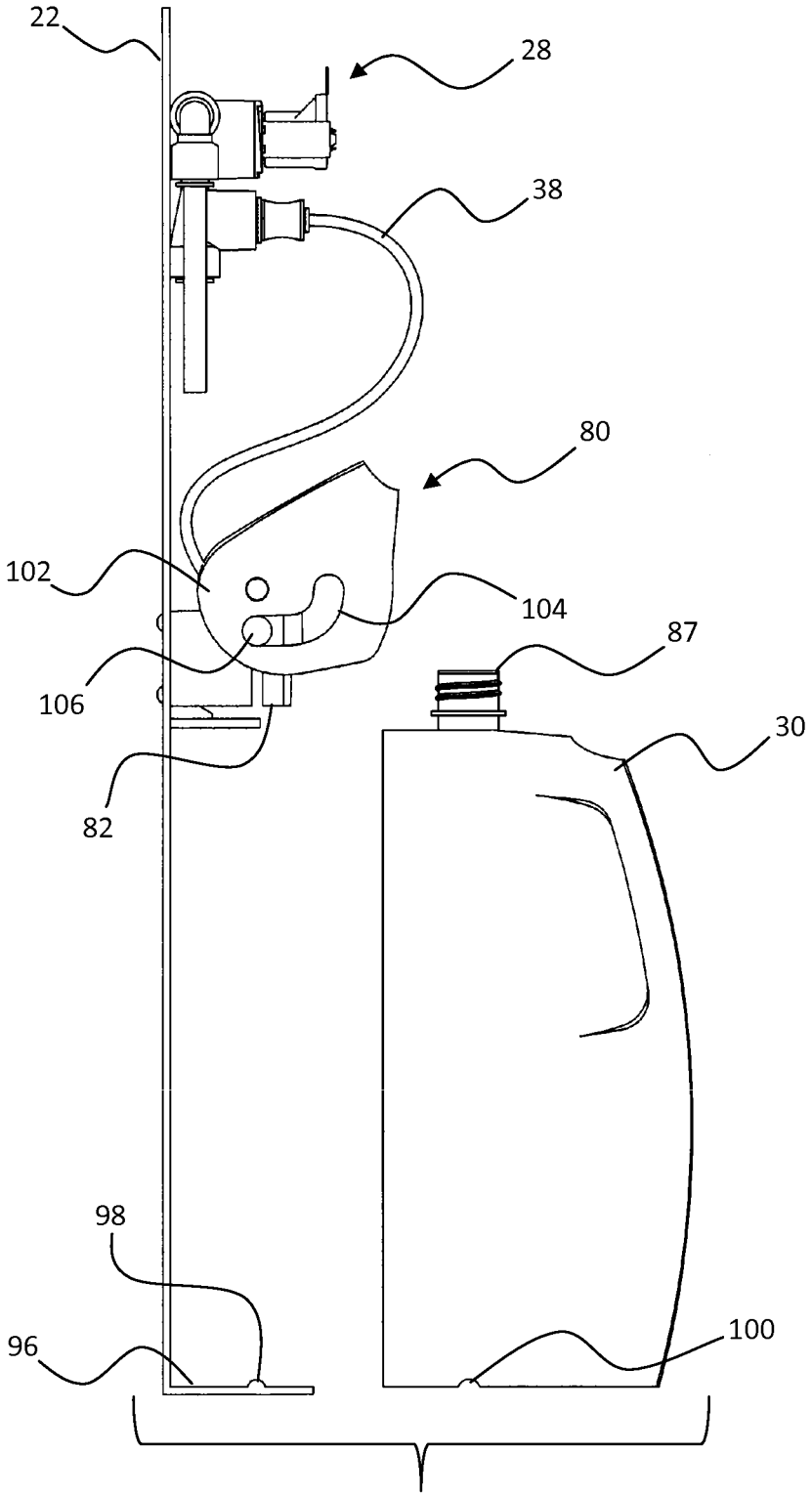
FIG. 8 is a side view of the injector assembly and concentrate container depicted in FIG. 5, wherein the concentrate container is removed from the chemical dispensing assembly.
Figure 9:
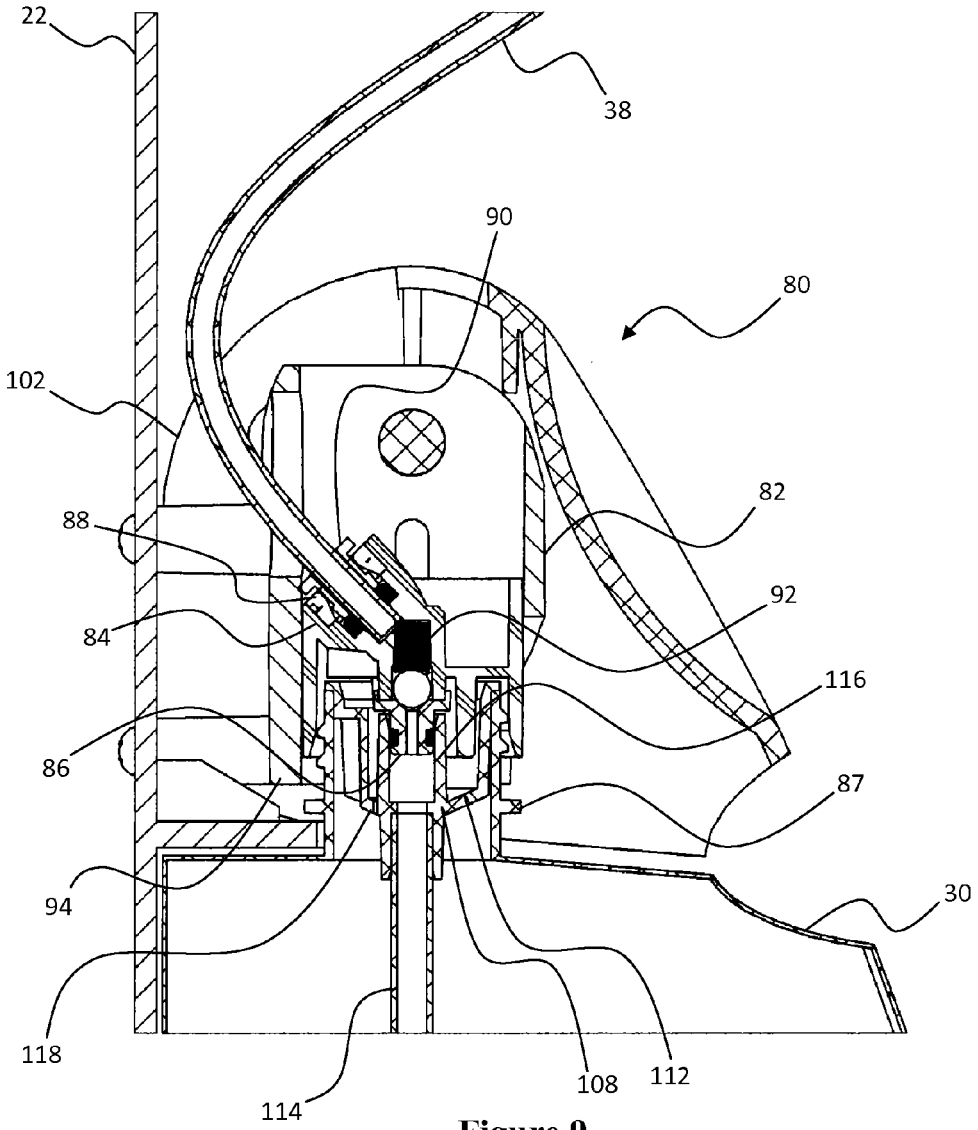
FIG. 9 is a cross-sectional side view of a locking assembly according to an embodiment, wherein the locking assembly is positioned to fluidly connect an injector assembly with a concentrate container.
Figure 10:
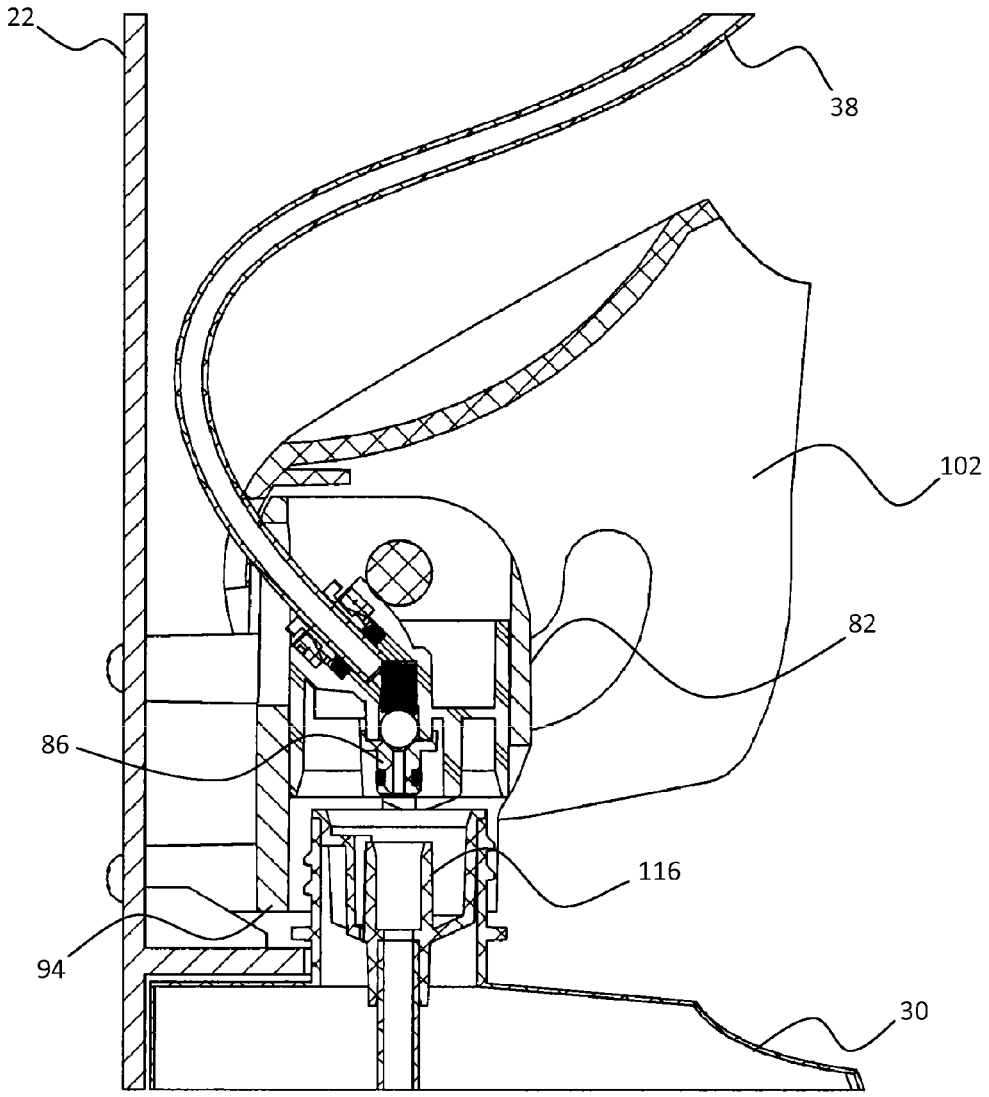
FIG. 10 is a cross-sectional side view of the locking assembly depicted in FIG. 5, wherein the locking assembly is positioned to disconnect the fluid connection between the injector assembly and the concentrate container.

As depicted in FIGS. 6-10, in certain embodiments, the locking assembly 80 can further comprise a track 94 for aligning the engagement head 82 with the concentrate container 30 and guiding the engagement head 82 as the engagement head 82 moves vertically between the engaged position and the disengaged position. In this configuration, the mounting frame 22 can further comprise a support shelf 96 for receiving and supporting the concentrate container 30 as depicted in FIGS. 6-8. The support shelf 96 can further comprise an alignment element 98 engagable to corresponding notch 100 in the concentrate container 30 to align the mouth 87 of the concentrate container 30 with the adapter 86.

As depicted in FIGS. 6-10, the locking assembly 80 can further comprise a rotatable handle 102 comprising a non-linear notch 104. In this configuration, the engagement head 82 further comprises a protrusion 106 receivable within the notch 104, wherein the notch 104 is oriented and shaped such that rotation of the handle 102 applies a downward or upward force on the engagement head 82 to move the engagement head 82 between the engaged position and the disengaged position. In certain embodiments, the notch 104 is curved to retain resist vertical movement of the engagement head 82 when the adapter 86 is inserted into the mouth 87 of the concentrate container 30 to prevent inadvertent disengagement of the adapter 86 from the concentrate container 30 while concentrate is being drawn from the concentrate container 30.

As depicted in FIGS. 9-10 and 17-18, the chemical dispensing assembly 20 can further comprise a container insert 108 insertable into the concentrate container 30. The container insert 108 further comprises a keyed connector 112 and a concentrate tube 114. The keyed connector 112 further comprises an overlapping adapter 116 for receiving the adapter 86 of the engagement head 82 when the engagement head 82 is positioned in the engaged position to fluidly connect the concentrate supply line 38 with the concentrate tube 114. In certain embodiments, the keyed connector 112 further comprises a mouth interface 118 for aligning the overlapping adapter 116 with the center of the mouth 87 of the concentrate container 30 and preventing concentrate from leaking past the overlapping adapter 116 when the engagement head 82 is positioned in the disengaged position or when the concentrate container 30 is being connected to the chemical dispensing assembly 20. The concentrate tube 114 is sized to extend the length of the concentrate container 30 to draw concentrate from the bottom of the concentrate container 30. In one aspect, the concentrate tube 114 can further comprise a screen or filter 124 to prevent solids, participated crystals or other particulates from entering the concentrate tube and being drawn into the injector assembly 28.

As depicted in FIGS. 14-16, the container insert 108 can further comprise at least one keyed tab 120 positioned proximate to the overlapping adapter 116. In this configuration, the engagement head 82 can further comprise at least keyed tab 122 paired with the keyed tab 120 of the container insert 108. Each paired keyed tabs 120, 122 are shaped to mirror or misaligned with the corresponding keyed tab 120, 122 such that the engagement head 82 can be moved into the engaged position with the mouth 87 of the container 30 without engagement of the keyed tabs 120, 122. If mismatched pair of keyed tabs 120, 122 is used, the keyed tabs 120, 122 are engaged as the engagement head 82 is moved into the engaged position preventing connection of the adapter 86 with the overlapping adapter 116 thereby preventing fluid connection of the concentrate supply line 38 with the concentrate container 30. In certain embodiments, the keyed tabs 120, 122 can be oriented radially or axially to prevent an incorrect keyed tab 120, 122 from moving past the opposing keyed tab 120, 122 without engagement.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A chemical dispensing assembly, comprising:

a manifold assembly defined by a plurality of injector assemblies, the manifold assembly having a motive fluid inlet supplying a motive fluid to an inlet line, each injector assembly including an inlet valve assembly and a venturi injector assembly;

a plurality of locking assemblies, each locking assembly including an engagement head and a rotatable handle, wherein the engagement head is fluidly coupled to a concentrate supply line and a concentrate tube; and a plurality of concentrate containers, each concentrate container having a container mouth adapted for engagement by the engagement head such that the concentrate tube is retained within the concentrate container, wherein each engagement head of the locking assemblies includes a head protrusion residing within a non-linear track of the rotatable handle of a respective locking assembly such that rotating the rotatable handle causes the engagement head to move non-rotatably vertically from a disengaged position to an engaged position thereby selectively disengaging or engaging the container mouth, wherein, upon engagement of the container mouth with the engagement head, selective actuation of each inlet valve assembly directs flow of the motive fluid to each corresponding venturi injector assembly such that a concentrated chemical within the corresponding concentrate container is conveyed through the corresponding concentrate tube and into the corresponding concentrate supply line, and wherein the concentrated chemical is introduced into the motive fluid within the venturi assembly such that a mixed solution is dispensed through a solution outlet line on the venturi injector assembly.

2. The chemical dispensing assembly of claim 1, wherein each venturi injector assembly includes a metering assembly including a restrictor plug, said restrictor plug reducing an effective cross-sectional area of the corresponding concentrate supply line to control flow of the concentrated chemical into the venturi injector assembly.

3. The chemical dispensing assembly of claim 2, wherein each restrictor plug is individually replaceable such that the effective cross-sectional area can be varied to change the flow of the concentrated chemical into the venturi injector assembly.

4. The chemical dispensing assembly of claim 1, wherein each engagement head includes a keyed head and each container mouth includes a keyed mouth such that the engagement head is adapted for engagement to concentrated containers having a corresponding keyed mouth.

5. The chemical dispensing assembly of claim 4, wherein the keyed head and the keyed mouth comprise one or more keyed tabs.

6. The chemical dispensing assembly of 1, further comprising a mounting frame, wherein the manifold assembly and the plurality of locking assemblies are attached to the mounting frame.

7. The chemical dispensing assembly of claim 6, wherein the mounting frame includes a support shelf, wherein the plurality of concentrate containers are positioned on the support shelf, each concentrate container being positioned below the corresponding locking assembly.

8. The chemical dispensing assembly of claim 1, wherein in the engaged position of the engagement head, the non-linear track is configured to prevent an adapter of the engagement head from disengaging with the concentrate container.

9. The chemical dispensing assembly of claim 8, wherein the adapter of the engagement head fluidly couples the concentrate supply line to the concentrate tube of the concentrate container.

10. The chemical dispensing assembly of claim 9, the engagement head further comprising a one-way valve configured to allow one-way flow of the concentrate into the adapter from the concentrate container.

11. The chemical dispensing assembly of claim 1, wherein a container insert is mounted within the container mouth, the container insert including a container key, wherein the container key engages an engagement head key on the corresponding engagement head.

12. The chemical dispensing assembly of claim 11, wherein the concentrate tube is fluidly connected to the container insert.

13. A chemical dispensing assembly, comprising:

a manifold assembly defined by an injector assembly, the manifold assembly having a motive fluid inlet supplying a motive fluid to an inlet line, the injector assembly including an inlet valve assembly and a venturi injector assembly;

a locking assembly including an engagement head and a rotatable handle, wherein the engagement head is fluidly coupled to a concentrate supply line and a concentrate tube; and a concentrate container having a container mouth adapted for engagement by the engagement head such that the concentrate tube is retained within the concentrate container, wherein the engagement head of the locking assembly includes a head protrusion residing within a non-linear track of the rotatable handle such that rotating the rotatable handle causes the engagement head to move non-rotatably vertically from a disengaged position to an engaged position thereby selectively disengaging or engaging the container mouth, wherein, upon engagement of the container mouth with the engagement head, actuation of the inlet valve assembly directs flow of the motive fluid to the venturi injector assembly such that a concentrated chemical within the concentrate container is conveyed through the concentrate tube and into the concentrate supply line, and wherein the concentrated chemical is introduced into the motive fluid within the venturi assembly such that a mixed solution is dispensed through a solution outlet line on the venturi injector assembly.

* * * * *